US005873403A

United States Patent [19]

Roller et al.

[11] Patent Number: 5,873,403

[45] Date of Patent: Feb. 23, 1999

[54] CONTINUOUS CASTING INSTALLATION WITH A HEATABLE MULTIPLE-CHAMBER FURNACE WITH FURNACE-DEPENDENT MOLD

[75] Inventors: Erling Roller, Essen; Günter Phillipps, Köln, both of Germany

[73] Assignee: Mannesmann Aktiengesellschaft, Düsseldorf, Germany

[21] Appl. No.: 831,191

[22] Filed: Apr. 2, 1997

Related U.S. Application Data

[63] Continuation of Ser. No. 645,576, May 14, 1996, abandoned.

[30] Foreign Application Priority Data

Jun. 22, 1995 [DE] Germany ..... 195 23 715.3

[51] Int. Cl.[6] ..... B22D 11/16

[52] U.S. Cl. ..... 164/155.7; 164/440

[58] Field of Search ..... 164/452, 440, 164/490, 155.7, 154.1

[56] References Cited

U.S. PATENT DOCUMENTS

| | | | |
|---|---|---|---|
| 4,150,714 | 4/1979 | Atkins et al. | 164/440 |
| 4,244,420 | 1/1981 | Dain | 164/440 |
| 4,730,659 | 3/1988 | Clark et al. | 164/440 |
| 5,360,054 | 11/1994 | Kaneko et al. | 164/440 |

FOREIGN PATENT DOCUMENTS

| | | | |
|---|---|---|---|
| 4325432 | 2/1995 | Germany . | |
| 60-106647 | 5/1985 | Japan | 164/440 |
| 60106647 | 12/1985 | Japan . | |
| 3-268844 | 11/1991 | Japan | 164/490 |
| 2156253 | 4/1985 | United Kingdom . | |

*Primary Examiner*—Kuang Y. Lin

*Attorney, Agent, or Firm*—Cohen, Pontani, Lieberman & Pavane

[57] ABSTRACT

A continuous casting installation with a heatable, pressure-regulated multiple-chamber furnace and a furnace-dependent mold for casting a molten metal. The pressure ratios in the pressure chamber of the furnace are regulated in accordance with its degree of fullness by a pressure generating device in order to maintain a constant metallostatic pressure in the mold chamber of the furnace. In order to improve the reliability with which the filling state is determined, the mold is fitted statically to a furnace-independent supporting frame and the multiple-chamber furnace is dynamically supported on a weighing device. Additionally, the mold is connected with the multiple-chamber furnace in a frictional engagement via a compressible seal.

2 Claims, 1 Drawing Sheet

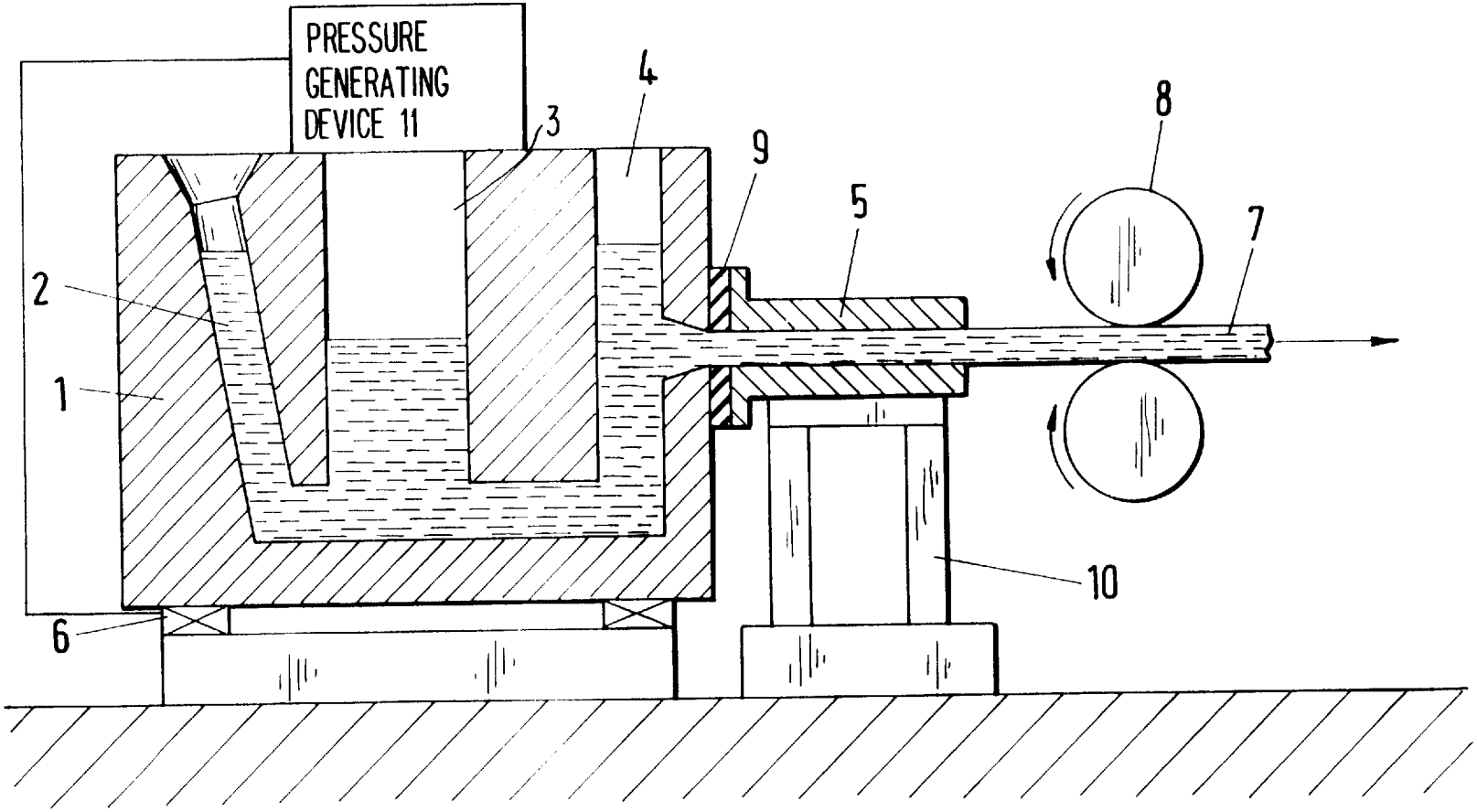
PRESSURE GENERATING DEVICE 11
1
2
3
4
5
6
7
8
9
10

CONTINUOUS CASTING INSTALLATION WITH A HEATABLE MULTIPLE-CHAMBER FURNACE WITH FURNACE-DEPENDENT MOLD

The present application is a continuation application of Ser. No. 08/645,576, filed 05/14/96, now abandoned.

FIELD OF THE INVENTION

The invention is d a continuous casting installation with a heatable multiple-chamber furnace with a furnace-dependent mold for the casting of molten metal.

DESCRIPTION OF THE PRIOR ART

DE 43 25 432 discloses a horizontal continuous casting plant with a warming or holding vessel which is constructed as a pressure chamber. The vessel is charged with the molten metal to be cast through an inlet channel and the molten metal is removed via an outlet channel and fed to a mold. The holding vessel is closed in pressure-tight fashion by a cover which is connected to a pressure generating device.

In order to maintain a constant metallostatic pressure in the mold, the level of the molten metal in the outlet channel is maintained constant in that the pressure ratios in the holding vessel are varied in accordance with its degree of fullness. For this purpose, bath level detection devices are provided in the outlet channel and in the holding vessel. These bath level detection devices make reference directly to the medial boundary layer between the volume of the outlet channel and holding vessel which is filled by the molten metal and the volume of the outlet channel and holding vessel which is not filled with molten metal. However, it is known from experience in the operation of such devices that mechanical, thermal or electric bath level detection devices arranged in this way are very unreliable due to high temperatures on the one hand and, on the other hand, because of the slag produced, particularly when casting heavy metal alloys.

Another problem with the known continuous casting installation is that the longitudinal axes of the outer molds in the casting direction assume a widening angle of variable magnitude relative to the strand guidance of the strand axes running parallel to one another in multiple-strand continuous casting, due to inevitable thermal deformation of the furnace vessel. When the parallel-guided strands are withdrawn, different strand withdrawal forces occur in the individual strands. These forces are brought about by transverse forces depending on the angular position of the respective mold relative to the strand withdrawal direction. Furthermore, the strand quality is negatively affected by structural changes during the solidification process.

SUMMARY OF THE INVENTION

Accordingly, it is an object of the present invention to provide a continuous casting installation in which the filling state is measured in a more reliable manner was previously possible and in which the longitudinal directions of the molds remain parallel regardless of the thermal ratios of the furnace.

Pursuant to this object, and others which will become apparent hereafter, one aspect of the present invention resides in a continuous casting installation which includes a heatable multiple-chamber furnace having a mold chamber and a pressure chamber in flow connection with one another. An inlet channel permits charging of molten metal into the pressure chamber. A pressure generating device is provided for maintaining a constant metallostatic pressure in the mold chamber by regulating pressure ratios in the pressure chamber as a function of the degree of fullness of the pressure chamber. A furnace-dependent mold arrangement is mounted to the furnace by a compressible seal. A support frame independent of the furnace statically holds the mold arrangement. A weighing device supports and weighs the multiple chamber furnace and is connected to the pressure generating device so as to transmit the weight information thereto. The pressure generating device then uses this weight information to determine the degree of fullness of the pressure chamber.

In a further embodiment of the invention means are provided for withdrawing the strand from the mold. The weighing device being operative to weigh the multiple-chamber furnace only when the strand withdrawal means is in an inactive mode.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The single figure shows a schematic, partly sectional view of a horizontal continuous casting installation pursuant to the present invention.

DETAILED DESCRIPTION OF THE PREFERRED EMBODIMENTS

As seen in the figure, the essential component of the inventive horizontal continuous casting installation is a pressure-controlled multiple-chamber furnace 1 having a pressure chamber 3. The pressure chamber 3 is charged with the molten metal to be cast via an inlet channel 2. The furnace 1 further has a mold chamber 4 which is in a flow connection with the pressure chamber 3.

Associated with the pressure chamber 3 is a pressure generating device 11 which regulates the gas pressure of the volume not containing molten metal above the bath level of the pressure chamber 3 as a function of the filling degree of the multiple-chamber furnace 1, in order to maintain a constant metallostatic pressure in the mold chamber 4.

The multiple-chamber furnace 1 is dynamically supported on a weighing device 6 which detects the gross weight of the multiple-chamber furnace 1. This gross weight, comprising the empty weight of the operational multiple-chamber furnace 1 and the weight of the molten metal located in the multiple-chamber furnace 1, constitutes a measurement of the degree of filling of the multiple-chamber furnace 1 and, as such, a regulating variable for the pressure generating device 1.

The measurement value for the filling degree of the multiple-chamber furnace 1 is advantageously independent of incrustation due to the unavoidable slag formation in the chambers 3 and 4 and is accordingly very reliable.

A mold arrangement 5 is fitted to the multiple-chamber furnace 1. This mold arrangement 5 can be a single mold, e.g., for casting strips, or a plurality of molds arranged adjacent to one another, e.g., for multiple-strand round continuous casting. An important feature of the invention is that this mold arrangement 5 is mounted separately on a supporting frame 10 which is independent of the furnace 1. Additionally, the mold arrangement 5 is connected with the multiple-chamber furnace 1 by a frictional engagement via a compressible seal 9 so that there is a flow connection between the mold arrangement 5 and the mold chamber 4 of the multiple-chamber furnace 1.

A horizontally directed force acts between the mold arrangement 5 and the multiple-chamber furnace 1, and results from a static contact pressure force from the frictional engagement of the mold arrangement 5 with the multiple-chamber furnace 1, which contact pressure force is diminished by the strand withdrawal force produced by a strand withdrawal device 8. In the case of permanently oscillating strand withdrawal, a moderate, substantially constant contact pressure force takes place. The vertically directed gravitational force of the multiple-chamber furnace 1 which acts orthogonally to the contact pressure force on the weighing device 6 remains unaffected by the process of withdrawing the strand.

In another embodiment of the invention, in the case of discontinuously intermittent strand withdrawal, the weighing device 6, as a measuring element, is activated exclusively when the strand withdrawal device 8 is inactive. The discontinuously intermittent strand withdrawal is formed of successive cycles having the following phase sequence: pull-pause-recoil-pause, wherein the pauses can have a duration of several seconds. During the pauses, the force between the mold arrangement 5 and the multiple-chamber furnace 1 is free of dynamics and, to this extent, the pause phases are suitable in a particularly advantageous manner for precise determination of the filling degree of the multiple-chamber furnace 1.

The slight vertical movement of the multiple-chamber furnace 1 which takes place when the filling degree changes and which is required for the weighing process has no significant effect on the casting process since the molten metal enters the mold arrangement through the seal 9 in a free-flowing state and only gradually solidifies therein.

Accordingly, the gross weight which is detected by the weighing device 6 is advantageously diminished by the substantially constant weight component of the mold arrangement 5 and the variable weight component of the strand 7, and thus the ratio of the filling weight of the molten metal to the gross weight is accordingly improved to a greater measuring accuracy.

Further, by avoiding a rigid mechanical coupling between the multiple-chamber furnace 1 and the mold arrangement 5, it is ensured that inevitable thermal distortions of the wall of the multiple-chamber furnace 1 on the mold side will not lead to a change in the position of the mold axes of a multiple-strand casting installation. On the contrary, such distortions are compensated for by the compressible seal 9 so that mold axes of a multiple-strand mold arrangement 5 which are aligned so as to be parallel before the commencement of casting will also remain parallel during casting regardless of the thermal deformation effects.

The invention is not limited by the embodiments described above which are presented as examples only but can be modified in various ways within the scope of protection defined by the appended patent claims.

I claim:

1. A continuous casting installation, comprising:

a heatable multiple-chamber furnace having a mold chamber, a pressure chamber in flow connection with the mold chamber, and an inlet channel in communication with the pressure chamber to permit charging of molten metal; pressure generating means for maintaining a constant metallostatic pressure in the mold chamber by regulating pressure ratios in the pressure chamber as a function of its degree of fullness with molten metal;

a furnace-dependent mold arrangement in a flow connection with the mold chamber;

a furnace-independent support frame, the mold arrangement being statically mounted to the furnace-independent support frame;

weighing means for dynamically supporting and weighing the multiple-chamber furnace, the weighing means being connected with the pressure generating means so as to transmit weight information thereto; and compressible seal means for connecting the mold arrangement to the multiple-chamber furnace.

2. A continuous casting installation according to claim 1, and further comprising strand withdrawal means for withdrawing a strand of metal from the mold, the strand withdrawal means having an active mode in which the stand is withdrawn from the mold, and an inactive mode, the weighing means being operative to be active only when the strand withdrawal means is in the inactive mode.

* * * * *